US007737352B2

(12) United States Patent
Chang

(10) Patent No.: US 7,737,352 B2
(45) Date of Patent: Jun. 15, 2010

(54) INSTRUMENT STAND WITH VARIABLE SUPPORTING POSITIONS

(75) Inventor: Ming Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 126 days.

(21) Appl. No.: 12/134,876

(22) Filed: Jun. 6, 2008

(65) Prior Publication Data

US 2009/0302177 A1 Dec. 10, 2009

(51) Int. Cl.
*G10D 13/02* (2006.01)

(52) U.S. Cl. ..... 84/422.1; 84/422.2; 84/422.3; 248/166; 248/188.7; 248/434; 248/435

(58) Field of Classification Search ..... 84/422.1, 84/422.2, 422.3; 248/166, 434, 435, 168, 248/169, 170, 188.7, 440.1
See application file for complete search history.

(56) References Cited

U.S. PATENT DOCUMENTS 4,488,471 A 12/1984 Youakim ..... 84/422.3
5,018,426 A * 5/1991 Suzuki ..... 84/422.3
5,251,528 A * 10/1993 Kurosaki ..... 84/422.3
5,717,152 A 2/1998 Liao ..... 84/422.3
5,816,556 A 10/1998 Liao ..... 248/405
6,011,207 A 1/2000 Hoshino ..... 84/422.1
6,278,046 B1 8/2001 Sikra et al. ..... 84/422.1
6,329,584 B1 12/2001 Liao ..... 84/422.3
6,909,252 B2 * 6/2005 Xi ..... 318/400.29
2003/0209128 A1 * 11/2003 Hsieh ..... 84/422.3
2006/0042451 A1 * 3/2006 Marnell ..... 84/422.3

* cited by examiner

*Primary Examiner*—Amy J. Sterling
(74) *Attorney, Agent, or Firm*—Rosenberg, Klein & Lee

(57) ABSTRACT

An instrument stand with variable ground contact positions of its supporting pods is disclosed. It has a standing post mounted with two positioning rings. One of them is fixed, and the other can slide relative to the former. The positioning rings have several supporting bases and several connecting elements that fix with the supporting bases after angle adjustment. The supporting pods are locked on the two positioning rings. Each supporting pod is controlled by the relative motion of the two positioning rings to expand and collapse. The ground contact positions of the supporting pods of the invention are thus variable.

7 Claims, 7 Drawing Sheets

INSTRUMENT STAND WITH VARIABLE SUPPORTING POSITIONS

BACKGROUND OF THE INVENTION

1. Field of Invention

The invention relates to an instrument stand and, in particular, to an instrument stand with variable ground contact positions of the supporting pods.

2. Related Art

Please refer to U.S. Pat. No. 6,329,584. The three supporting pods of that invention have fixed relative angles. In addition to suitable disposition space, its space usage is very limited. For example it is difficult to increase the number of pedals between two supporting pods to two because of the limited space. Therefore, such an instrument stand has the restriction of limited space to adjust positions for other instruments.

Please refer to U.S. Pat. No. 6,278,046. In order to accommodate the two pedals, the instrument stand in that invention has only two supporting pods. Although more space is allowed for the two pedals, the installation procedure is complicated. Its stability is worse than the above-mentioned instrument stand with three pods.

It should be mentioned that the above-mentioned two conventional instrument stands have the same problem during their assembly. When installing supporting pods on a positioning ring, the first one is independent of the others. When another supporting pod is to be installed on the positioning ring, the installed supporting pod is likely to be damaged. The fact that these supporting pods cannot be installed independently causes problems for installation.

The present invention is proposed to solve the above-mentioned problems in the prior art.

SUMMARY OF THE INVENTION

An objective of the invention is to provide an instrument stand with variable ground contact positions of its supporting pods. Using the design of separated combining elements and supporting base, the orientations of the supporting pods can be adjusted before the combining elements are installed on the supporting base. Therefore, the space usage is more flexible. During the assembly, each supporting pod is first fixed on the corresponding combining element. The combining elements are then disposed on the supporting base of the positioning ring. The invention thus has a simpler installation. Moreover, the supporting pods will not be carelessly damaged during assembly.

To achieve the above-mentioned objective, the invention includes: a standing post, two positioning rings, and a plurality of supporting pods. The standing post is mounted with a tool for the music player. The two positioning rings are mounted around the lower portion of the standing post. One of them is fixed, whereas the other is able to slide within an appropriate interval relative to the former. Several supporting bases are symmetrically disposed around the outer side of each ring. Each supporting base has a first connecting part and several combining elements that can adjust angles relative to the supporting base. Each combining element has a second connecting part that connected with the first connecting part of the supporting base. A third connecting part extends from the second connecting part of each connecting element. The supporting pods change their supporting angles with the combining elements. The number of the supporting pods is the same as the number of the supporting bases on the rings. A crank is provided between the two ends of each supporting pod. One end of the supporting pod has a supporting part. Between the other end of the supporting pod and the end of the crank is provided with a fourth connecting part corresponding to the third connecting part of the combining element. Each supporting pod is controlled by the relative motion of the two positioning rings to expand and collapse.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
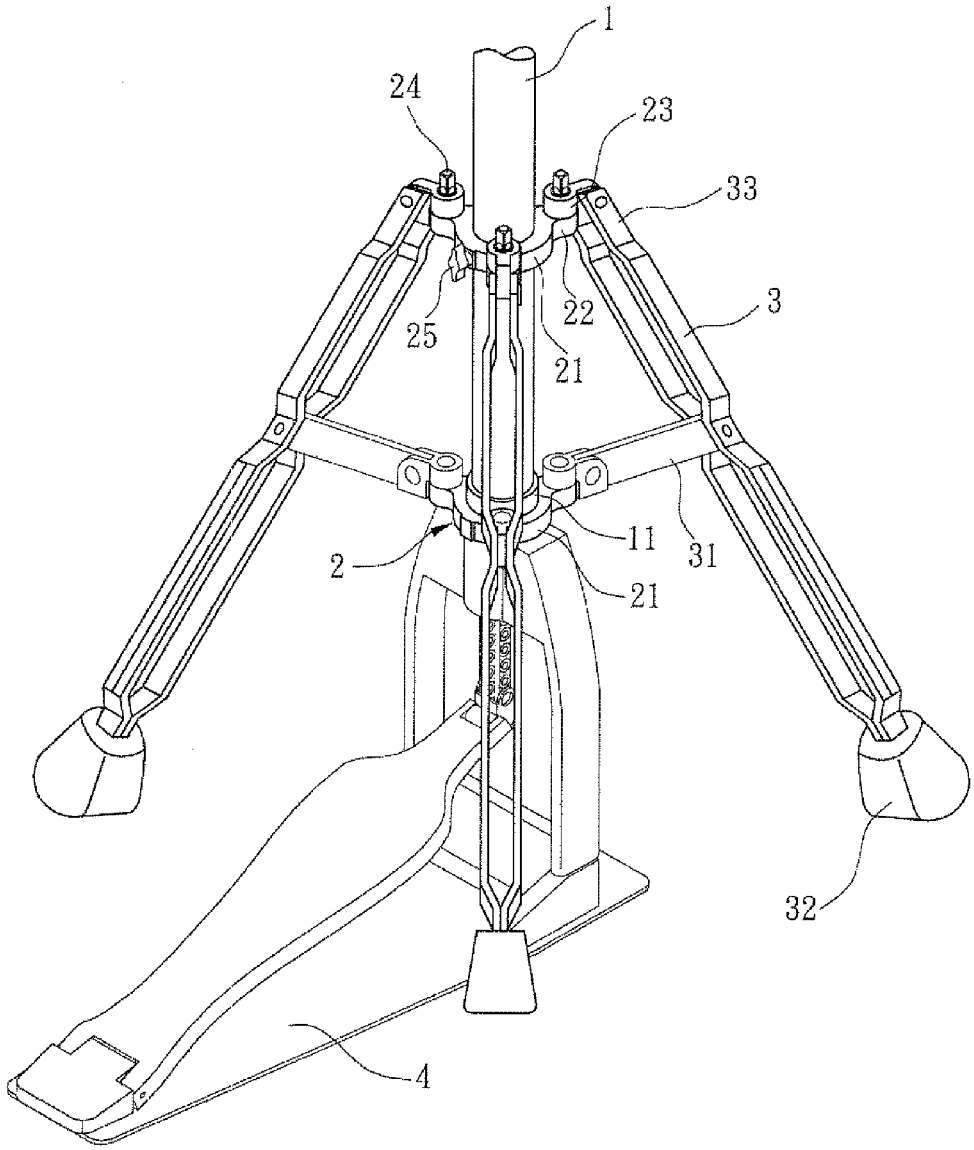
FIG. 1 is a three-dimensional perspective of the invention.
Figure 2:
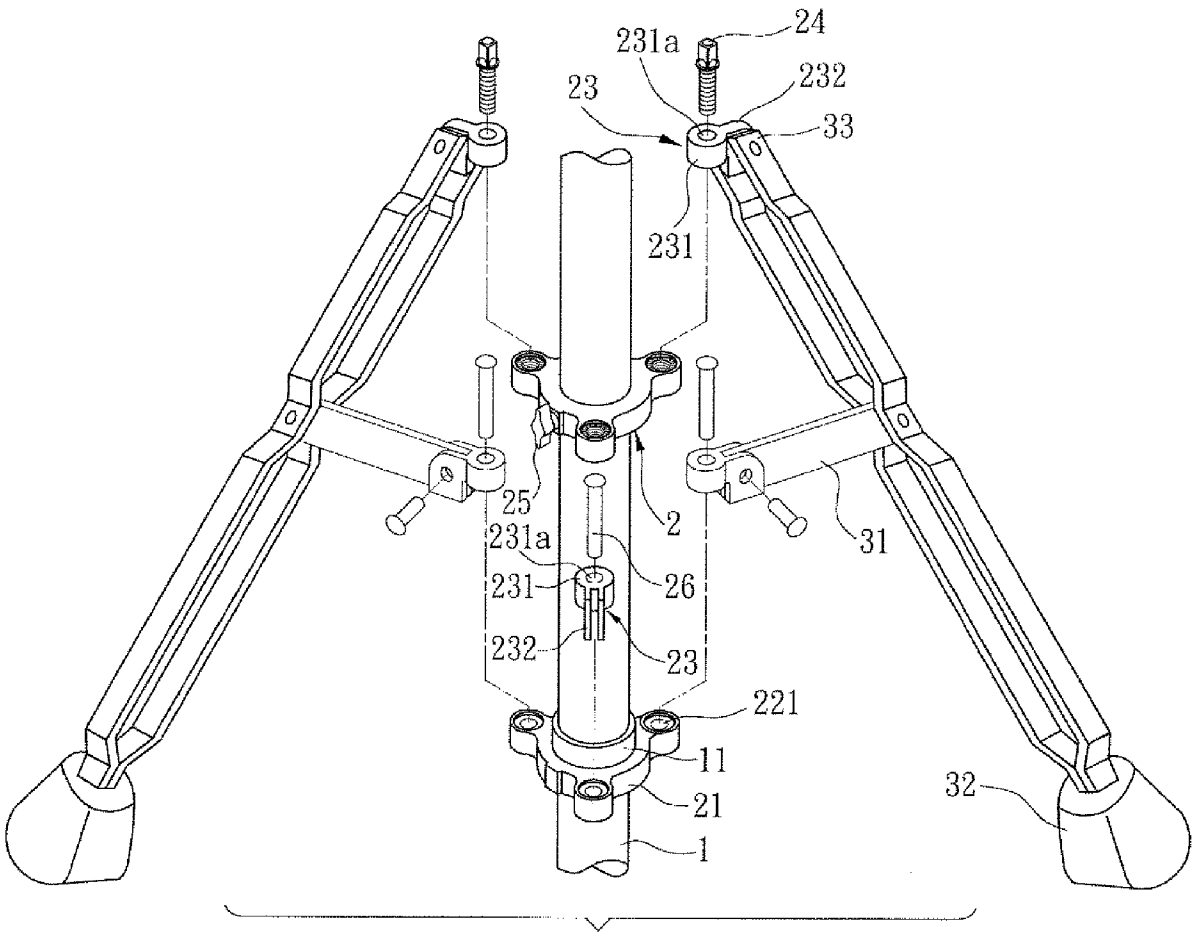
FIG. 2 is an exploded view of the invention.
Figure 3:
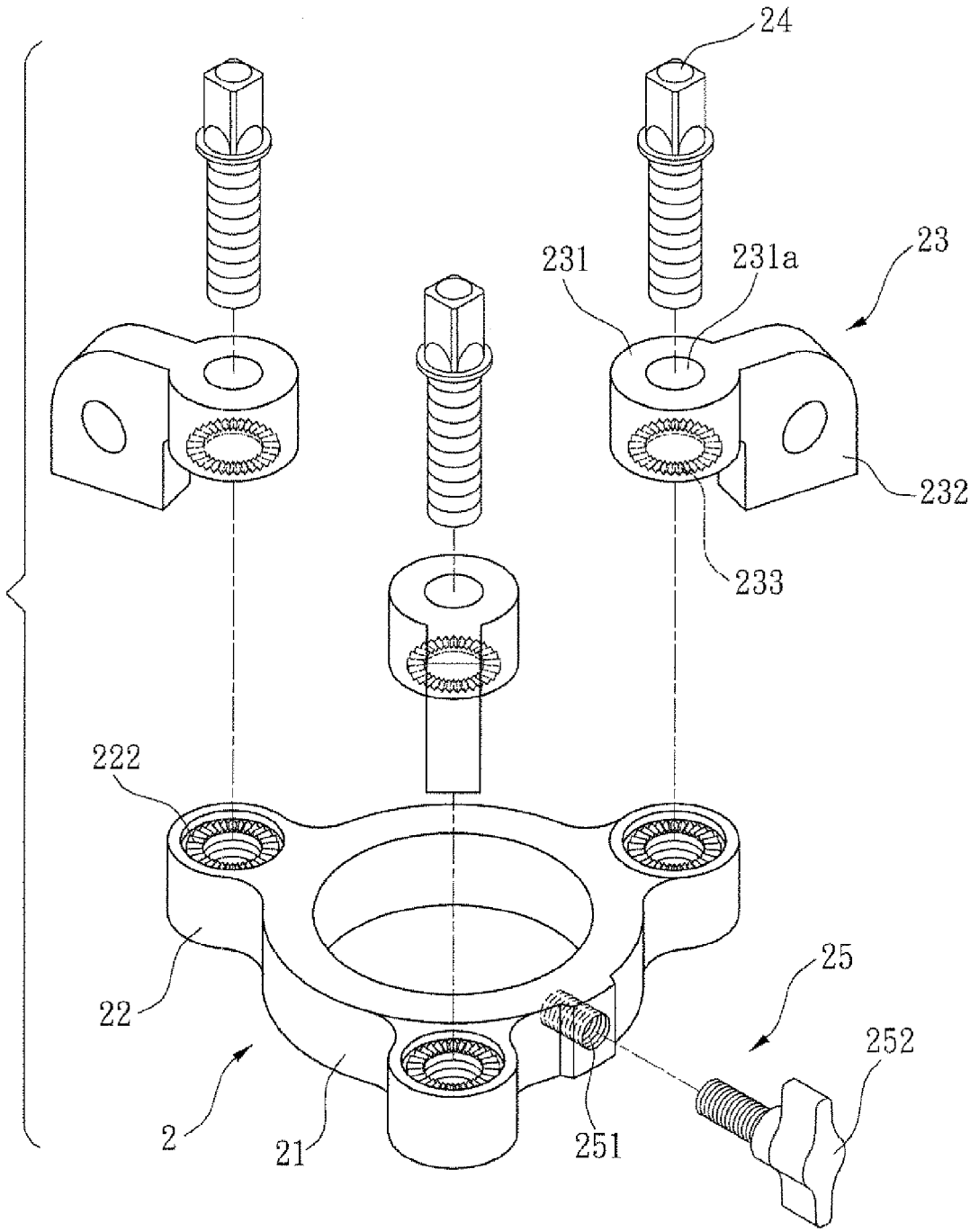
FIG. 3 is an exploded view of the disclosed positioning ring.
Figure 4:
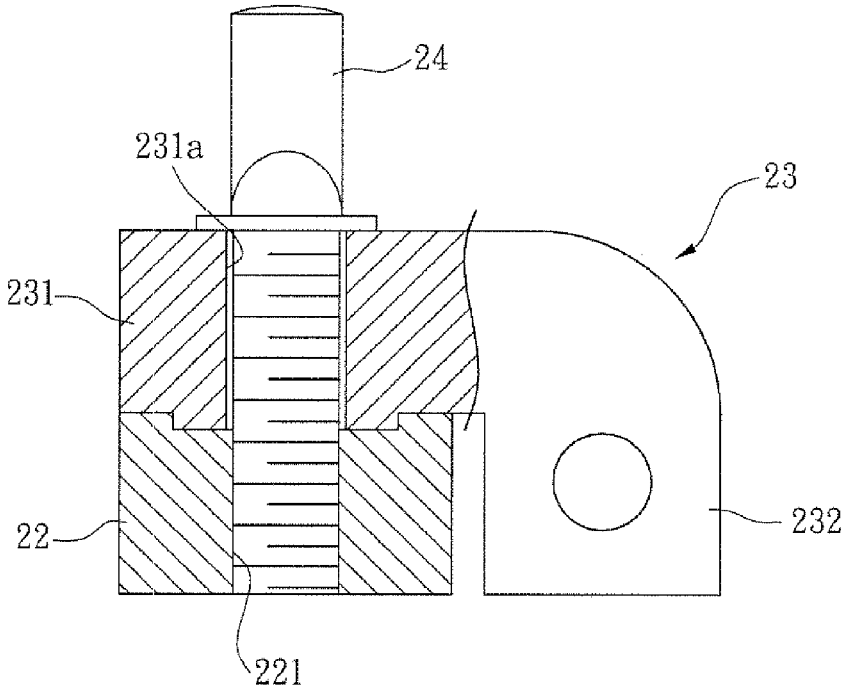
FIG. 4 is a schematic view showing the positioning between the supporting base and the combining element.

The present invention will be apparent from the following detailed description, which proceeds with reference to the accompanying drawings, wherein the same references relate to the same elements.

Please refer to FIGS. 1 to 4 for the structure according to the preferred embodiment of the invention. This example is used to explain the spirit of the invention, but should not be used to restrict the scope thereof.

This embodiment of the invention provides an instrument stand with variable ground contact positions of its supporting pods. It includes a standing post 1, two positioning rings 2, and several supporting pods 3.

The standing post 1 is mounted with a tool for the music player to use. In this embodiment, the tool is a jazz drum with a cymbal (not shown). The bottom of the instrument stand has a pedal 4 that connects to the hits the cymbal.

The two positioning rings 2 are mounted around the lower portion of the standing post 1. One of them is fixed, and the other is able to slide within an appropriate interval relative to the former. Each positioning ring 2 has a ring part 21. The outer side of the ring part 21 is symmetrically disposed with a plurality of supporting bases 22. Each of the supporting bases 22 has a first connecting part 221 and several connecting elements 23. The combining elements 23 are fixed after adjusting their supporting angles relative to the supporting bases 22. Each connecting element 23 has a second connecting part 231. The second connecting part 231 is connected and fixed to the first connecting part 221 of the supporting base 22. A third connecting part 232 extends from the second connecting part 231 of the connecting element 23.

The supporting pods 3 change their supporting angles with the combining elements 23. The number of the supporting pods 3 is the same as that of the supporting bases 22 on the ring part 21. A crank 31 is provided between the two ends of the supporting pods 3. One end of the supporting pod 3 has a supporting part 32. Each of the other end of the supporting pod 3 and the end of the crank 31 has a fourth connecting part 33 corresponding to the third connecting part 232 of the connecting element 23. Each supporting pod 3 is controlled by the relative motion of the two positioning rings 2 to expand and collapse.

In this embodiment, relative to the upper positioning ring 2, the first connecting part 221 is an inner screw hole. The second connecting part 231 has a through hole 231*a*. An outer screw element 24 goes through the through hole 231*a* of the second connecting part 231. After the supporting angles are adjusted, the outer screw element 24 locks in the first connecting part 221. An annular tooth part 222 is provided around the inner screw hole (first connecting part 221) on the side of the supporting base 22 opposite to the connecting element 23. The connecting element 23 has positioning teeth 233 corresponding to the annular tooth part 222 for temporary positioning when adjusting the angles.

Relative to the lower positioning ring 2, the first connecting part 221 is an inner hole. The second connecting part 231 also has a through hole 231*a*. A rivet 26 goes through the through hole 231*a* of the second connecting part 231. It goes through the inner hole and fixes in the first connecting part 221 after adjusting the supporting angles.

For at least one of the two positioning rings 2, a fixing part 25 for fixing the positioning ring 2 on the standing post 1 between any two supporting bases 22 on the outer ring side of the ring part 21. In this embodiment, the ring part 21 has a through screw hole 251. A locking element 252 locks in the screw hole 251 and urges against the standing port 1.

One of the two positioning rings 2 is fixed on the standing post 1. The other one slides relative to the fixed positioning ring 2. A stopping part 11 is provided at the end of the sliding stroke of the sliding positioning ring 2.

From the above description of the structure, the disclosed supporting pods 3 can change their ground contact positions by loosening the outer screw element 24 originally fixed in the inner screw hole (first connecting part 221) of the supporting base 22. The connecting elements 23 can thus adjust their positions. Correspondingly, the supporting pods 3 change their supporting angles. After the adjustment is done, the outer screw element 24 is again fixed in the inner screw hole (first connecting part 221) of the supporting base 22.

Figure 6:
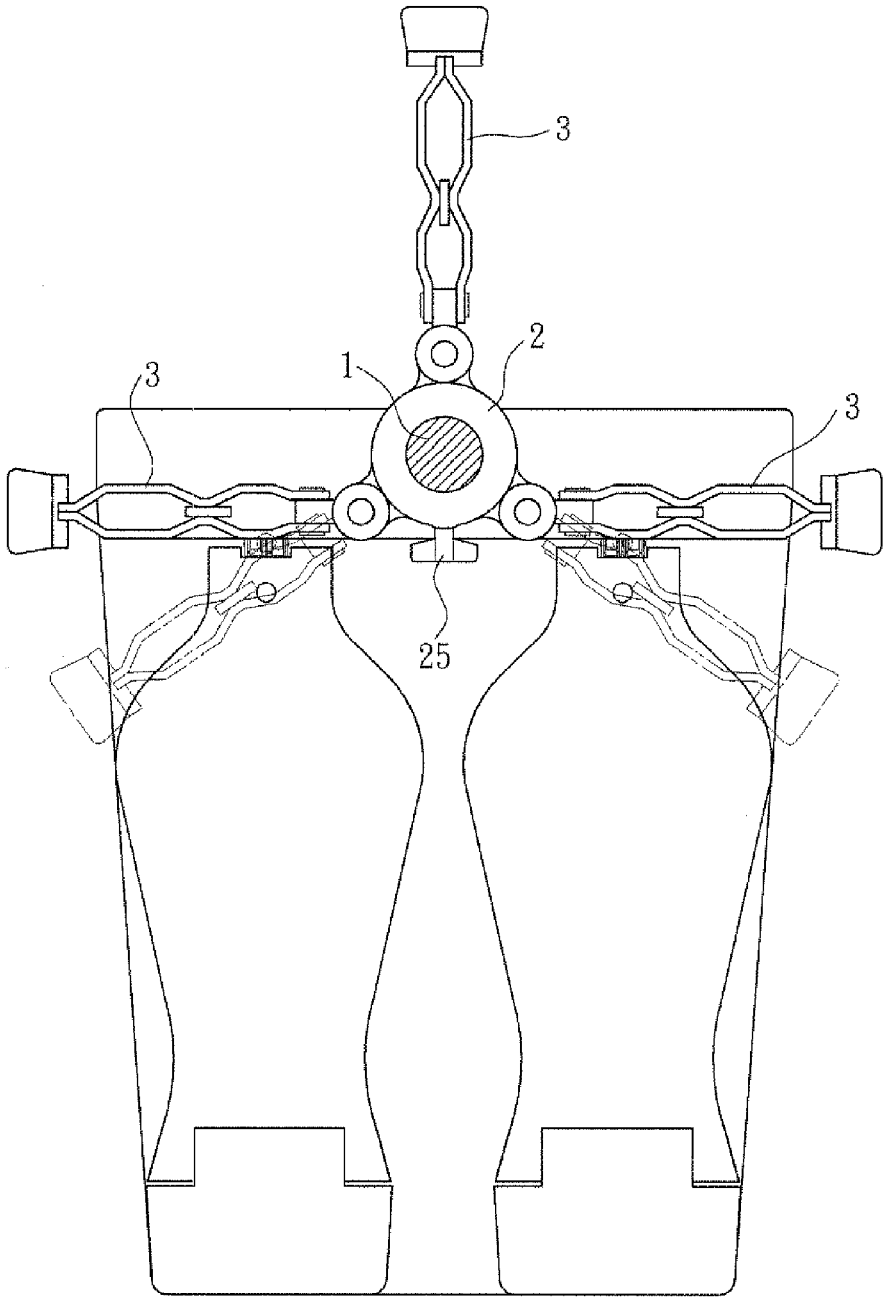
FIG. 6 is a schematic view showing how the invention is used.
Figure 7:
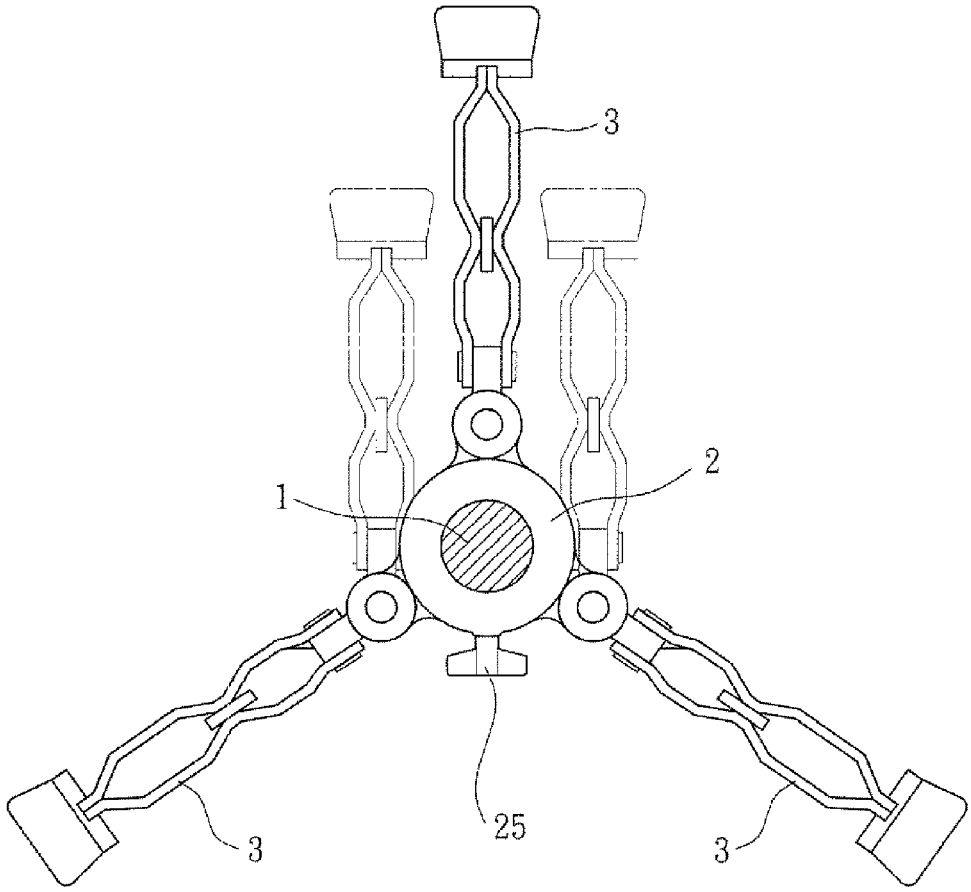
FIG. 7 is a schematic view showing how the angles of the instrument stand are adjusted.
Figure 8:
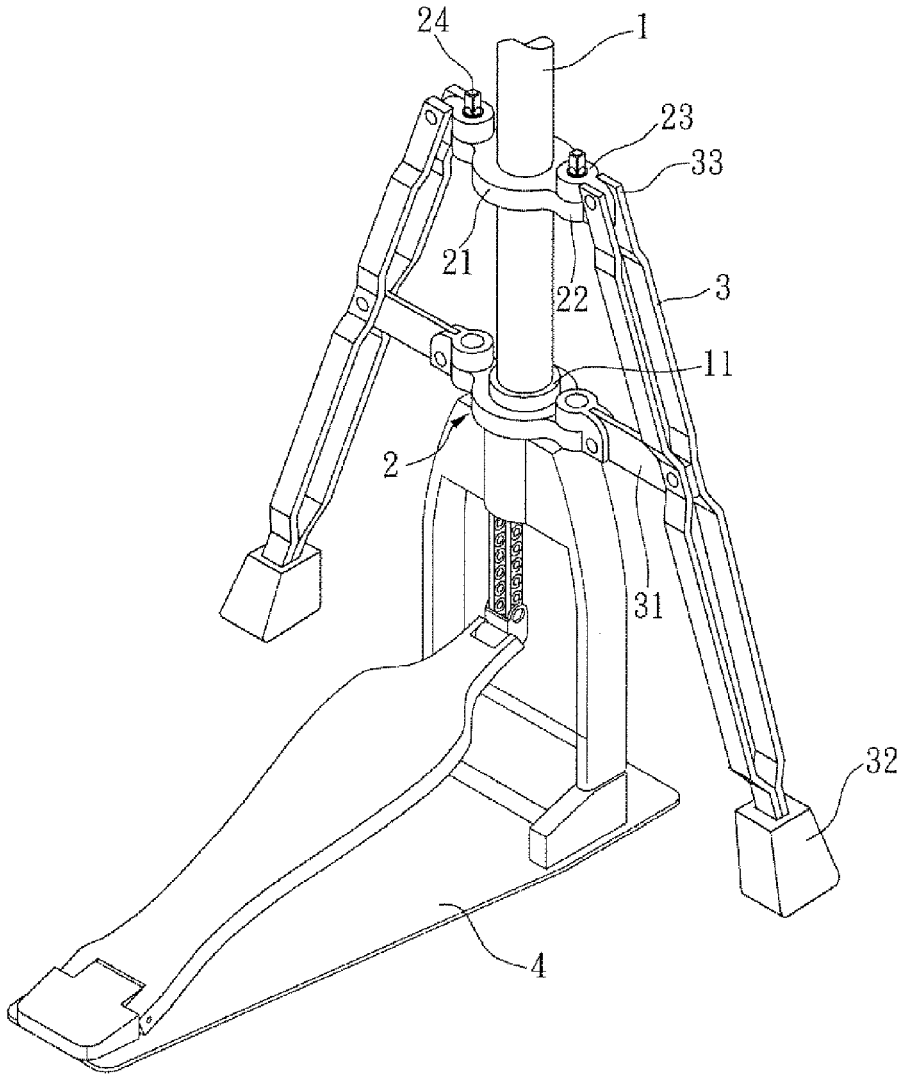
FIG. 8 is a schematic view showing the structure with two of the supporting pods in the disclosed instrument stand and one pedal.

Therefore, if space is required so that the ground contact positions of the supporting pods of the instrument stand have to be changed, their supporting angles can be adjusted following the above-mentioned procedure. As shown in FIG. 6, the pedals 4 are between two supporting pods 3 in this embodiment. A conventional instrument stand cannot accommodate two pedals. Suppose the disclosed instrument stand needs two pedals 4 or overlaps with other adjacent objects. One only needs to slightly adjust the positions of the supporting pods 3. The three adjusted supporting pods 3 can still firmly stand on the ground. Its stability and adjustability thereof are better than the conventional instrument stand. Besides, the supporting pods 3 can be adjusted to those shown in FIG. 7 so that the space is more flexible. Please refer to FIG. 8 for another embodiment of the invention. It is seen that the positioning ring 2 mounted on the standing post 1 has a supporting pod 3 on either side thereof. The two supporting pods 3 along with the pedal 4 enable the instrument stand to stand firmly. With such a structure, the angles of the supporting pods 3 can still be adjusted according to needs.

Figure 5:
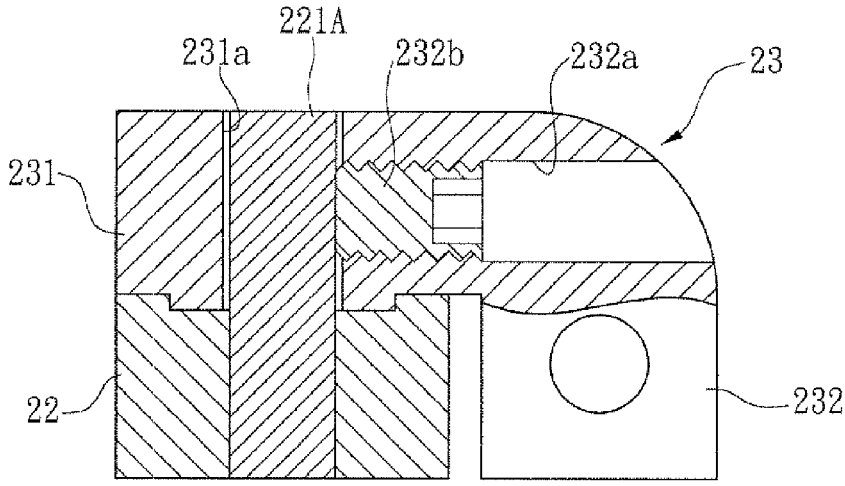
FIG. 5 is a schematic view showing the positioning between the supporting base and the combining element according to a second embodiment.

The invention of course has many examples with minor changes from the above embodiment in detail. Please refer to FIG. 5 for a second embodiment of the invention. It is different from the first embodiment in the following respects. The first connecting part 221A is a mounting rod protruding from the supporting base 22. The second connecting part 231 has a through hole 231*a* for the mounting rod (first connecting part 221A) to go through. The third connecting part 232 of the connecting element 23 has an inner screw part 232*a* going sideways through the through hole 231*a* of the second connecting part 231. A positioning screw 232*b* goes through the mounting rod (first connecting part 221A) in the through hole 231*a* of the second connecting part 231 and, after adjusting the supporting angles, locks in the inner screw part 232*a* to urge against the mounting rod (first connecting part 221A). Therefore, this achieves the same effect of locking the connecting element in the supporting base 22 as in the first embodiment.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An instrument stand with variable ground contact positions of its supporting pods, comprising:

a standing post, which is mounted with a tool for a music player to use;

two positioning rings mounted around the standing post, one of them being fixed and the other being able to slide within an appropriate interval relative to the former, wherein each positioning ring has a ring part whose outer side is symmetrically disposed with a plurality of supporting bases, each of which has a first connecting part, and a plurality of connecting elements that get fixed once their supporting angles relative to the supporting bases are adjusted, and a third connecting part extends from a second connecting part of each connecting element; and a plurality of supporting pods that change their supporting angles with the connecting elements, wherein the number of the supporting pods is the same as that of the supporting bases, a crank is provided between the two ends of each supporting pod, one end of the supporting pod has a supporting part, and each of the other end of the supporting pod and the end of the crank has a fourth connecting part corresponding to the third connecting part of the connecting element, and each supporting pod is controlled by the relative motion of the two positioning rings to expand and collapse.

2. An instrument stand with variable ground contact positions of its supporting pods as in claim 1, the first connecting part is an inner screw hole, the second connecting part has a through hole, an outer screw element goes through the through hole of the second connecting part and fixes in the first connecting part after angle adjustment.

3. An instrument stand with variable ground contact positions of its supporting pods as in claim 2, wherein an annular tooth part is formed around the inner screw hole on the side of the support base opposite to the connecting element, and the connecting element has positioning teeth opposite to the annular tooth part for temporary positioning when adjusting angles.

4. An instrument stand with variable ground contact positions of its supporting pods as in claim 1, wherein the first connecting part is protruded from the supporting base upwards with a mounting rod, the second connecting part has a through hole for the mounting rod to go through, the third connecting part of the connecting element has an inner screw part goes sideways through the through hole of the second connecting part, a positioning screw locks in the inner screw hole and urges against the mounting rod after the mounting rod is in the through hole of the second connecting part and the angle adjustment is done.

5. An instrument stand with variable ground contact positions of its supporting pods as in claim 1, wherein at least one of the positioning rings has a fixing part between any two supporting bases on the outer side of the ring part for fixing the fixed positioning ring on the standing post, the fixing part has a through screw hole at its ring part, and a locking element locks in the screw hole and urges against the standing post.

6. An instrument stand with variable ground contact positions of its supporting pods as in claim 1, wherein one of the two positioning rings is fixed on the standing post, the other slides relative to the fixed positioning ring, and a stopping part is provided at the end of the sliding stroke of the sliding positioning ring.

7. An instrument stand with variable ground contact positions of its supporting pods as in claim 1, wherein the first connecting part is an inner hole, the second connecting part has a through hole, and a rivet goes through the through hole of the second connecting part and the inner hole so that the rivet is fixed in the first connecting part after angle adjustment.

* * * * *